United States Patent [19]

Koester

[11] 4,381,630

[45] May 3, 1983

[54] FOUNDATION VENT STRUCTURE

[76] Inventor: John H. Koester, 1410 Colorado Ave. South, Minneapolis, Minn. 55416

[21] Appl. No.: 212,018

[22] Filed: Dec. 1, 1980

[51] Int. Cl.[3] ..... E02D 27/00

[52] U.S. Cl. ..... 52/169.5; 52/303

[58] Field of Search ..... 52/169.5, 169.11, 169.14, 52/303, 305, 198, 287, 310

[56] References Cited

U.S. PATENT DOCUMENTS

| | | | |
|---|---|---|---|
| 3,283,460 | 11/1966 | Patrick | 52/169.14 |
| 3,287,866 | 11/1966 | Bevilacqua | 52/169.5 |
| 3,850,193 | 11/1974 | Guzzo | 52/169.5 |
| 3,888,087 | 6/1975 | Bergsland | 52/169.5 |
| 4,045,964 | 9/1977 | Barclay | 52/169.5 |
| 4,245,443 | 1/1981 | Beecher | 52/305 |
| 4,253,285 | 3/1981 | Enright | 52/169.5 |

FOREIGN PATENT DOCUMENTS

| | | | |
|---|---|---|---|
| 2206444 | 2/1972 | Fed. Rep. of Germany | 52/169.5 |
| 2512488 | 9/1976 | Fed. Rep. of Germany | 52/303 |
| 271315 | 5/1927 | United Kingdom | 52/305 |

*Primary Examiner*—Price C. Faw, Jr.
*Assistant Examiner*—Henry E. Raduazo
*Attorney, Agent, or Firm*—Williamson, Bains, Moore & Hansen

[57] ABSTRACT

A foundation vent structure is positioned upon the footing of a building below the lowermost row of concrete blocks of the basement wall and extends below the concrete floor of the basement. The vent structure is formed of a plastic material, preferably in strips, and is shaped to define alternate tunnels and channels having openings therein. The vent structure intercommunicates the openings in the hollow, concrete blocks with the drain area located along the marginal area below the basement wall to permit moisture to be vented into this drain area.

2 Claims, 6 Drawing Figures

FOUNDATION VENT STRUCTURE

SUMMARY OF THE INVENTION

This invention relates to a foundation vent structure for use in providing a moisture vent joint between the basement wall and footing and below the basement floor.

One of the long-standing problems in many domestic as well as commercial structures is the problem of damp or wet basements. Basements are subject to seepage and leakage because the basements are usually located below the surface of the ground. In the construction of basements, a drainage system is included in a basement structure and typically, comprises drain tile located below the basement floor along the peripheral portions thereof. This kind of drainage system allows moisture to be drained away without accumulating below the basement floor. However, moisture can also seep into the hollow, concrete blocks used in constructing basement walls and seep upon the basement floor.

There have been prior art attempts to provide a means of venting the lowermost row of concrete blocks at the time of construction to permit drainage or moisture from the concrete blocks into the drainage system. Such prior art attempts have included specially constructed concrete blocks (having vent openings therein) which are used in the lowermost row of blocks forming the basement wall. Concrete blocks of this kind are expensive and their use is not in accord with the present day construction practices.

It is an object of this invention to provide a foundation vent structure, preferably in the form of a strip or mat, which may be readily applied between the footing and basement wall during construction of the basement to intercommunicate the openings in the concrete blocks to the drainage system below the basement floor.

A more specific object of this invention is to provide a foundation vent structure which is shaped to define alternate tunnels and channels which vent the openings in the concrete blocks of the basement walls with the drain system located below the basement floor.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 1:
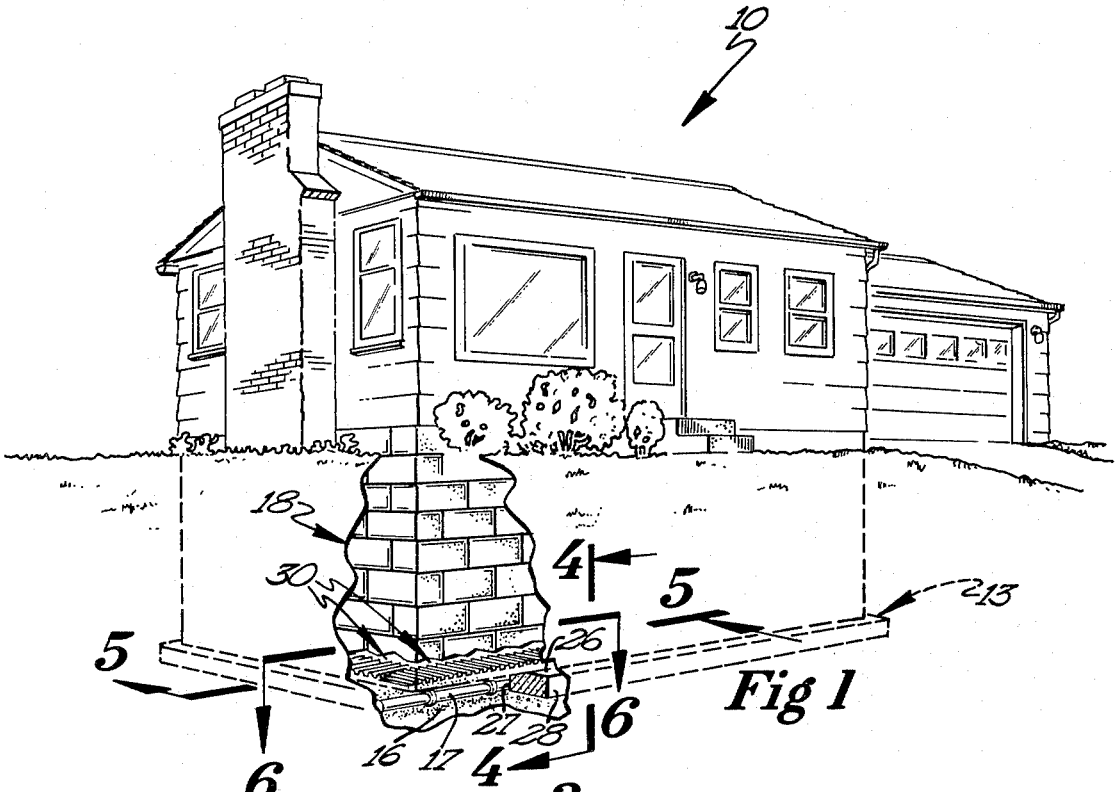
FIG. 1 is a perspective view of a house incorporating the novel foundation vent structure.

Referring now to the drawings, it will be seen that a house 10 is illustrated in FIG. 1 and incorporates the novel foundation vent device for use in providing a moisture vent joint between the vertical wall and the footing of the basement. In this regard, the house 10 is provided with a basement 11 comprised of a vertical wall 12 positioned upon a footing 13 formed of concrete in the usual manner. The basement also includes a floor 14 which is provided with strips of felt 15 underlying the marginal portions of the basement floor. The strips of felt 15 function as a conventional moisture barrier. The basement is also provided with a typical drainage system comprised of a drain zone 16 defined by a trench filled with gravel 16 below the marginal portions of the basement floor. A drain tile 17 is positioned at the lower portion of the drainage zone and serves to receive and direct moisture therefrom in the usual manner.

Figure 6:
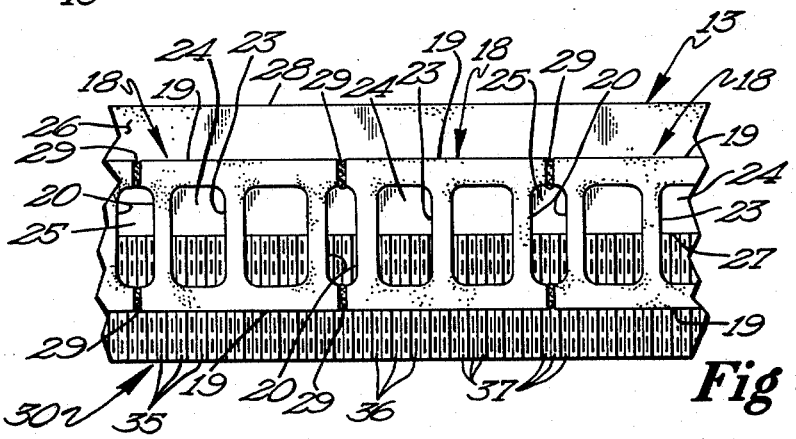
FIG. 6 is a cross-sectional view taken approximately along lines 6—6 of FIG. 1 and looking in the direction of the arrows.

The vertical walls 12 of the basement is formed of concrete blocks 18 of conventional construction including flat, substantially parallel longitudinal sides 19 and transverse ends 20. Referring now to FIG. 6, it will be seen that the transverse ends 20 have a centrally located recess 21 therein so that substantially flat vertical shoulders 22 are formed adjacent the longitudinal sides thereof. The concrete blocks 18 are hollow and are provided with a central web 23 to define interior vertically extending openings 24 therein. It will be appreciated that when the blocks are positioned in end-to-end relation, the recesses in adjacent blocks define exterior vertical openings 25 therebetween. Each of the vertical walls 12 of the basement 11 is positioned upon the upper horizontal surface 26 of the associated footing 13 and the inner surface of the basement wall is spaced inwardly of the inner vertical surface 27 of the footing. It will also be noted that the concrete blocks defining the basement wall are spaced inwardly of the outer vertical surface 28 of the footing. Suitable mortar 29 cements the blocks to the footing and to each other in a well-known manner.

The novel moisture vent structure 30 is disposed between the basement wall 12 and its associated footing 13 and extends below the basement floor 14. The vent structure 30 is of generally rectangular configuration and is formed of an inert, impervious plastic material which is sufficiently flexible so that it may be rolled into a roll for ease in shipping and handling. The vent structure may be unrolled and cut into a strip of desired length so that it may be positioned upon the footing throughout the length of the footing. The moisture vent structure has longitudinal edges 31 disposed in substantially parallel relation and has a width dimension sufficient to permit the vent structure to have one longitudinal edge positioned at the inner vertical edge 27 of the footing and have its other longitudinal edge positioned below the central portion of the row of concrete blocks defining the lowermost row, as best seen in FIG. 6. In commercial practice, the width of the vent structure may be within the range of eight to twelve inches, preferably twelve inches, to accommodate the construction parameters of most domestic structures.

Figure 2:
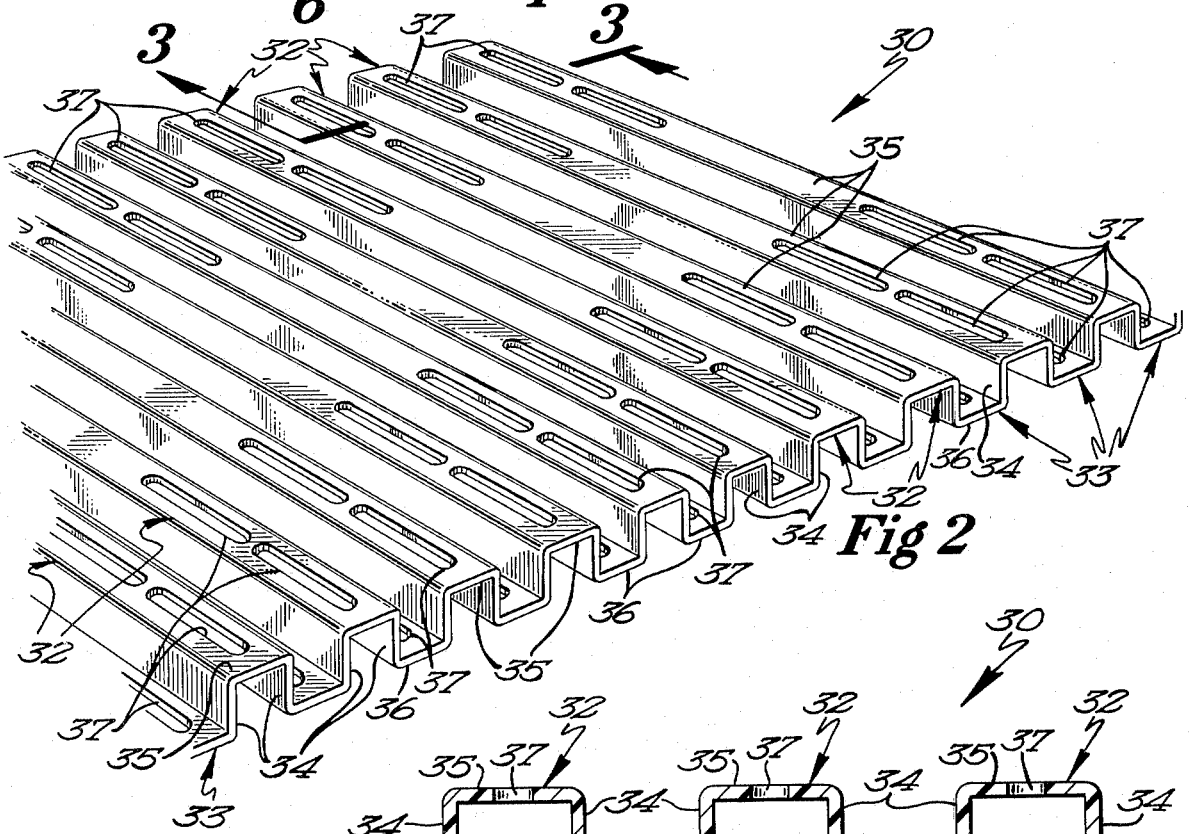
FIG. 2 is a perspective view of the novel foundation vent structure.
Figure 3:
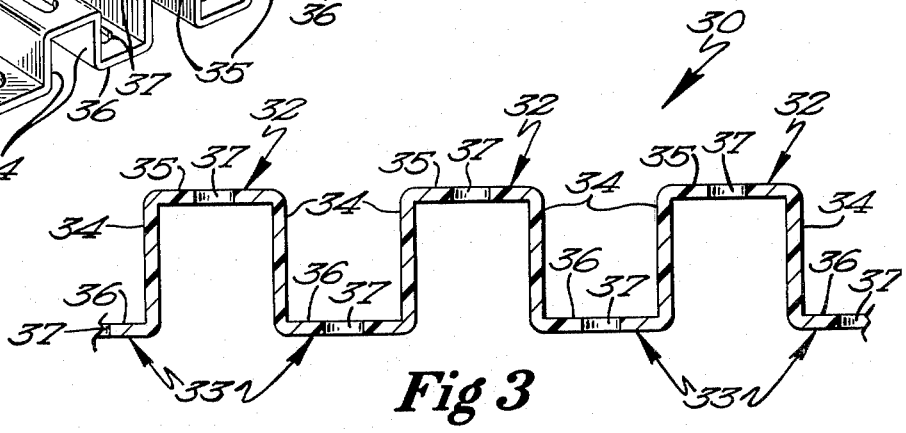
FIG. 3 is a cross-sectional view taken approximately along lines 3—3 of FIG. 2 and looking in the direction of the arrows.
Figure 4:
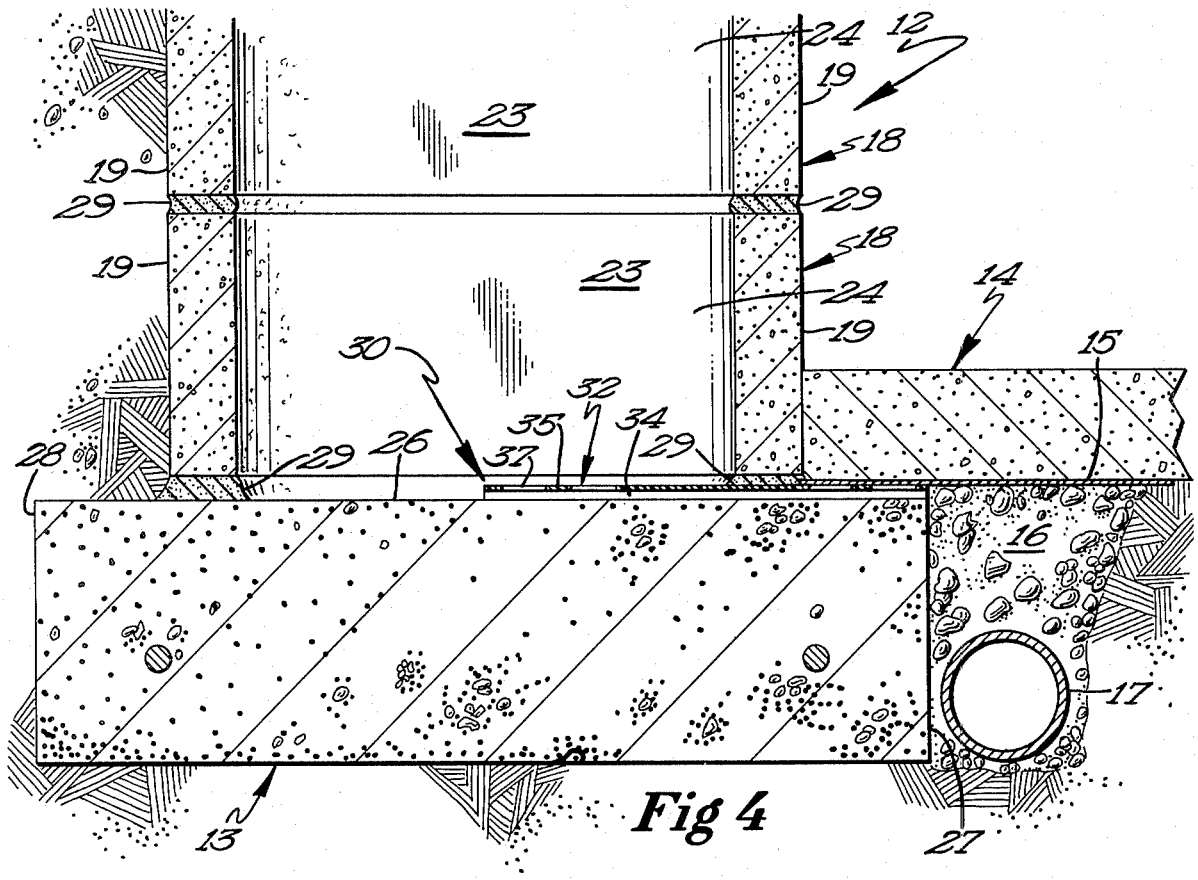
FIG. 4 is a cross-sectional view taken along lines 4—4 of FIG. 1.
Figure 5:
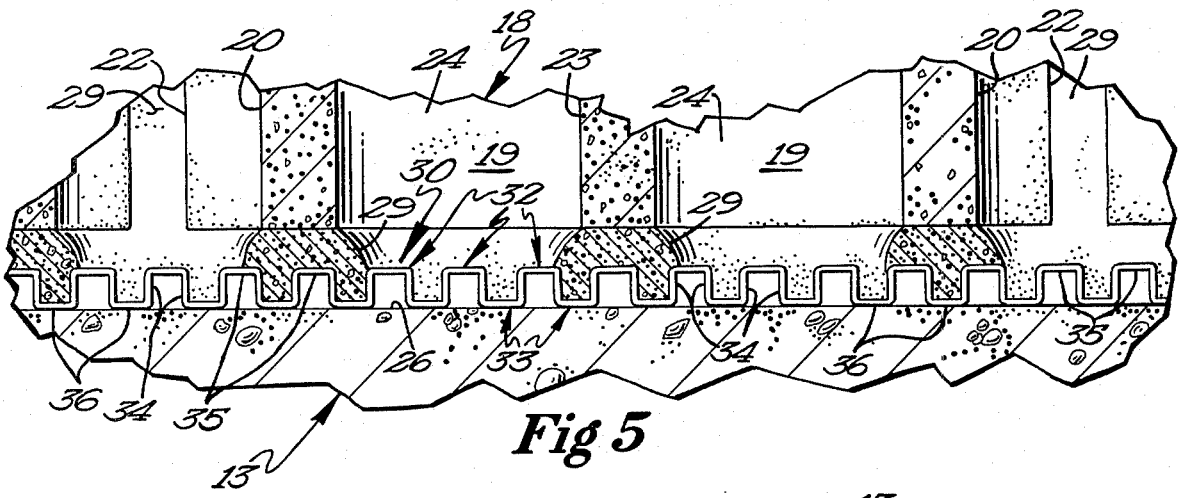
FIG. 5 is a cross-sectional view taken approximately along lines 5—5 of FIG. 1 and looking in the direction of the arrows.

Referring again to FIGS. 2, 3, and 5, it will be seen that the vent structure 30 is shaped to form alternate tunnels 32 and channels 33 which extend from one longitudinal edge to the other longitudinal edge thereof and throughout the length of the vent structure. Each tunnel 32 is formed of sides 34 which are integral with a horizontal web 35. Similarly, each channel 33 is formed of sides 34 which are integral with the horizontal web 36. In the embodiment shown, each channel and each tunnel is provided with a plurality of transversely spaced, apart transversely extending elongate openings 37 therein. It will be noted that openings 37 in each tunnel or channel extend throughout a substantial portion of the length of the tunnel or channel.

In use, the moisture vent structure 30 will be applied to the upper surface of the footing 13 during construction of the basement. The vent structure will be positioned so that one longitudinal edge thereof is located adjacent the inner vertical surface 27 of the footings. The lowermost layer of concrete blocks 18 will then be positioned on the footing and upon the vent structure. Mortar will be applied to the upper surface of the footing and vent structure. Additional mortar may be applied to the upper surface of the footing located beyond the outer longitudinal edge of the vent structure to level the concrete block. The basement wall will then be erected in the conventional manner. The drainage system and drain tile will also be installed and the moisture barrier felt strips will be positioned adjacent the inner periphery of the wall in a wellknown manner. Thereafter, the basement floor will be poured in the usual manner thereby completing the construction of the basement.

Referring again to FIGS. 5 and 6, it will be seen that the vent structure will extend to approximately the mid-portions of the concrete blocks and the mid-portions of the interior vertical openings 24 therein and the exterior openings 25 therebetween. At least one of the vertical openings 37 in each tunnel will be disposed in communication with the interior openings in the blocks or the exterior openings therebetween. Therefore, any moisture which might tend to accumulate within the blocks will pass through the openings into the tunnel and eventually pass into the drain system below the basement wall. The openings 37 in the tunnels and channels are of sufficient length so that it is highly unlikely that any particular opening will be completely clogged by any mortar which happens to fall downwardly during the laying of the concrete blocks. Further, the vent structure requires no particular orientation because of its symmetrical construction. The channels will form tunnels or, alternatively, or the tunnels will form channels regardless of which surface of the vent structure is presented upwardly.

The moisture vent structure is formed of a plastic material and can be readily molded or extruded to have the configuration shown. The vent structure may be produced in a continuous fashion and rolled into rolls to permit ease in handling. Strips of the desired length corresponding to the length of the footing may be readily cut at the job site. Thus, the production of the vent structure is inexpensive and may be readily applied in the construction of the basement without departing from the established construction practices.

From the foregoing, it will be seen that I have provided a novel moisture vent structure which is not only of simple and inexpensive construction, but one which functions in a more efficient manner than any heretofore known comparable structure.

It is anticipated that various changes can be made in the size, shape and construction of the foundation vent structure device disclosed herein without departing from the spirit and scope of the invention as defined by the following claims.

What is claimed is:

1. A foundation vent structure for use in providing a moisture vent joint between each vertical wall and the footing of a basement, and below the basement floor, the vertical walls of the basement being formed of hollow concrete blocks having an interconnecting web between the sides thereof to define vertically oriented openings therein, drain tile being positioned below the marginal portions of the basement floor, said vent structure being formed of a flexible, impervious plastic material and being of elongate generally rectangular shaped configuration having substantially straight, parallel longitudinal edges, said vent structure being shaped throughout its length to define alternate tunnels and channels, said tunnels and channels extending transversely from one longitudinal edge to the other longitudinal edge of the vent structure, each tunnel and each channel including substantially, parallel vertical sides integral with and interconnected by a web, each vertical side being common to an adjacent tunnel and channel, the webs of the tunnels and channels being perforated to permit moisture to pass through the perforations, said vent structure being adapted to be positioned upon the footing of a basement wall along substantially the length of the footing and below the lowermost row of concrete blocks, said vent structure having a width dimension of sufficient magnitude to extend beyond the inner edge of the footing below the basement floor and to the central portion of the concrete blocks to intercommunicate the opening in the concrete blocks with the perforations in the webs of the tunnels and channels to permit water and moisture to be vented below the basement into the drain tile thereof.

2. The foundation vent structure as defined in claim 1 wherein the channels of said vent structure are adapted to receive mortor therein which is used to cement the concrete blocks to the footing.

* * * * *